US006130654A

United States Patent [19]

Hayashi et al.

[11] Patent Number: 6,130,654

[45] Date of Patent: Oct. 10, 2000

[54] DRIVING METHOD OF A LIQUID CRYSTAL DISPLAY DEVICE

[75] Inventors: Hisaaki Hayashi; Makoto Shibusawa, both of Hyogo-ken, Japan

[73] Assignee: Kabushiki Kaisha Toshiba, Kawasaki, Japan

[21] Appl. No.: 09/028,638

[22] Filed: Feb. 24, 1998

[30] Foreign Application Priority Data

Feb. 24, 1997 [JP] Japan ..... P09-038748
Feb. 13, 1998 [JP] Japan ..... P10-030870

[51] Int. Cl.[7] ..... G09G 3/30

[52] U.S. Cl. ..... 345/63; 345/77; 345/215

[58] Field of Search ..... 345/63, 77, 215, 345/92

[56] References Cited

U.S. PATENT DOCUMENTS 4,743,896 5/1988 Hashimoto et al. ..... 340/784
5,489,919 2/1996 Kuwata et al. ..... 345/100
5,867,139 2/1999 Tanaka et al. ..... 345/92

*Primary Examiner*—Richard A. Hjerpe
*Assistant Examiner*—Marthe Y. Marc-Coleman
*Attorney, Agent, or Firm*—Oblon, Spivak, McClelland, Maier & Neustadt, P.C.

[57] ABSTRACT

In an active-matrix type liquid crystal display device, a dummy scanning line is provided at a higher position than the top of ordinary scanning liens in the case that a scanning operation is performed from the top of a display region to the bottom thereof. Alternatively, such a dummy scanning line is disposed at a lower position than the bottom of ordinary scanning lines where the scanning operation is performed from the bottom of the display region to the top thereof. Scanning pulses to turn on switching elements as well as compensation pulses are applied to the dummy scanning line as to the ordinary scanning lines to obtain a uniform brightness display on a screen of the active-matrix type liquid crystal display device.

13 Claims, 10 Drawing Sheets

DRIVING METHOD OF A LIQUID CRYSTAL DISPLAY DEVICE

BACKGROUND OF THE INVENTION

Field of the Invention

This invention relates to a driving method of a liquid crystal display device and, more particularly, a driving method suitable for an active-matrix type liquid crystal display device.

An active-matrix type liquid crystal display device (called hereinafter the "AM LCD") generally includes an array substrate, a counter substrate provided opposite to the array substrate with a predetermined gap and a liquid crystal layer disposed in the gap. The array substrate is provided with a glass plate, a plurality of signal lines made of a low electric resistance material, such as aluminum, a plurality of scanning lines made of tungsten molybdenum (MoW) crossing the signal lines in a matrix form, and thin film transistors (called hereinafter the "TFTs") disposed in the vicinities of the cross points thereof as switching elements. The signal and scanning lines and the TFTs are formed on the glass plate. Pixel electrodes connected to the TFTs are disposed at pixels surrounded by the signal and scanning lines. The pixel electrodes are made of indium tin oxide (ITO). An alignment layer is formed to cover the pixel electrodes on the glass plate. The counter substrate, on the other hand, includes a counter electrode made of ITO on the inner surface of which an alignment layer is formed. Japanese Patent No. 2523587 discloses an AM LCD which includes a dummy line in addition to the scanning lines and capacitors defined by pixel electrodes at the top and bottom rows and the dummy lines. The dummy line is formed in the same layer as in the scanning lines and is supplied with a predetermined voltage.

Where a driving method is adapted to compensate for punching-through voltages in the AM LCD, significant shifts occur with respect to the optimum common voltages for one region of pixel electrodes to define the capacitors with the dummy line and for another region to define capacitors with the scanning lines. As a result, the brightness of images in the former region is different from that in the latter region so that the overall image is not satisfactory in display quality.

SUMMARY OF THE INVENTION

One object of the present invention is to provide a driving method of an AM LCD which is capable of displaying uniform brightness images.

A driving method of the present invention adapts the punching-through voltage compensation drive. The driving method is applied to an AM LCD including ordinary scanning lines, signal lines, TFTs, first and second groups of pixel electrodes connected to the scanning and signal lines through the TFTs, and a dummy scanning line. In this AM LCD, ordinary storage capacitors are defined between the ordinary scanning lines and the first group of pixel electrodes, and additional storage capacitors are also defined between the second group of pixel electrodes and the dummy scanning line. The structure, however, does not enable the second group of pixel electrodes to define storage capacitors with the ordinary scanning lines.

The driving method of this invention is characterized by application of compensation pulses to the dummy scanning line. This causes the optimum common voltage at the first group of pixel electrodes connected to the 1st row ordinary scanning line to be substantially the same as at the second group of pixel electrodes connected to the dummy scanning line.

Further, the driving method of the present invention is also characterized by application of the compensation and scanning pulses to the dummy scanning line. Where the compensation pulse only is applied to the dummy scanning line and the compensation and scanning pulses are applied to the scanning line, the potential waveforms at the second group of pixel electrodes are different from those at the first group of pixel electrodes by components corresponding to the scanning pulses. Thus, the effective voltage applied to the liquid crystal at the second group of pixel electrodes is smaller than that applied to the liquid crystal at the first group thereof. As a result, the brightness of regions at the first group of pixel electrodes is much better than that at the second group thereof. Since the compensation and scanning pulses are applied to the dummy scanning line in accordance with the present invention, the driving voltage of the dummy scanning line is substantially the same as that of the ordinary scanning lines and the effective voltage applied to the liquid crystals at the second group of pixels is substantially equal to that at the first group of the pixel electrodes. As a result, the brightness of regions at the second group of pixel electrodes is substantially equal to that at the first group thereof so that uniform brightness images are displayed on the screen, i.e., a more uniform display can be obtained than in the case that the compensation pulse only is applied to the dummy scanning line.

The above-stated and other objects and advantages of the invention will become apparent from the following description when taken with the accompanying drawings. It is understood, however, that the drawings are for purposes of illustration and are not to be construed as defining the scope or limits of the invention, reference being had for the latter purpose to the claims appended hereto.

BRIEF DESCRIPTION OF THE DRAWINGS

In the drawings wherein like reference characters denote like components in the several views.

DESCRIPTION OF THE PREFERRED EMBODIMENT

A driving method of an AM LCD of a first embodiment in accordance with the present invention will be described with reference to the attached drawings.

The AM LCD is a normally white type light transmission display device. The display device includes array and counter substrates, alignment layers provided on the substrates, respectively, to face each other, a gap defined between the alignment layers, a liquid crystal layer disposed in the gap, and two sheets of polarlizers respectively provided on the outer surfaces of the substrates.

Figure 5:
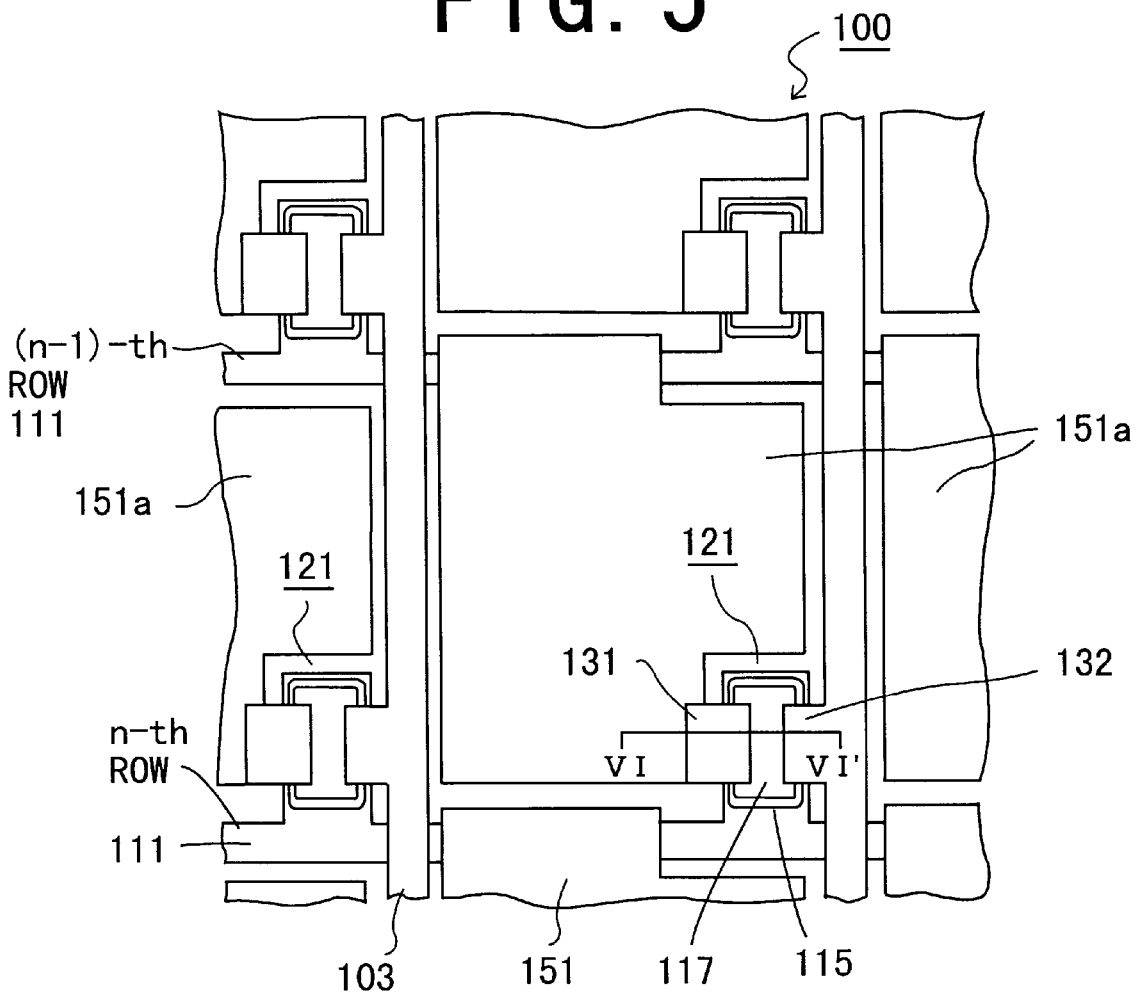
FIG. 5 is a partial plan view to illustrate the structure of a display region on the array substrate in accordance with the invention.
Figure 6:
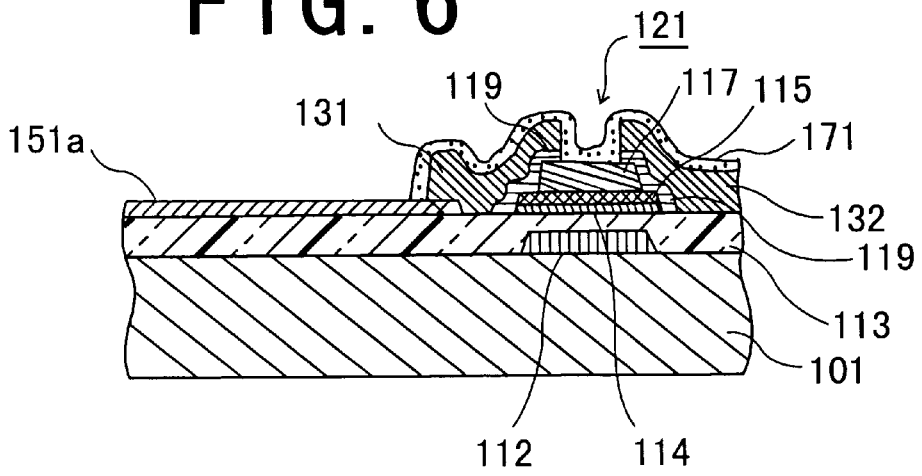
FIG. 6 is a sectional view of the array substrate taken along the line VI-VI' of FIG. 5.

The array substrate has such a structure as shown in FIGS. 5 and 6. FIG. 5 is a partial plan view of the array substrate 100 while FIG. 6 is a sectional view taken along the line VI-VI' thereof.

The array substrate 100 includes (1,024×3) signal lines 103 and 768 scanning lines 111 crossing the signal lines 103 at substantially right angles. The scanning lines 111 are directly formed on a glass substrate 101 and a gate insulation layer 113 made of silicon oxide covers the scanning lines 111 and the glass plate 101. The signal lines 103 are disposed on the gate insulation layer 113. TFTs 121 are formed in the vicinities of the cross points of the signal lines 103 and the scanning lines 111 as switching elements. Pixel electrodes 151 made of ITO are provided to connect the TFTs 121, respectively.

A lamination structure of the TFT 121 includes a gate electrode 112 extending from the scanning line 111, the gate insulation layer 113, a gate silicon nitride 114, an a-Si semiconductor layer 115, and a channel protection layer 117 made of silicon nitride. The structure further includes a low resistance semiconductor layer 119 made of n+ a-Si, a source electrode 131 connected to the pixel electrode 151*a* and a drain electrode 132 connected to the signal line 103. As shown in FIG. 5, the pixel electrode 151*a* connected to the n-th row ordinary scanning line 111, (n≠1), through the TFT 121 defines a storage capacitor with the (n−1)th row ordinary scanning line 111.

Figure 4:
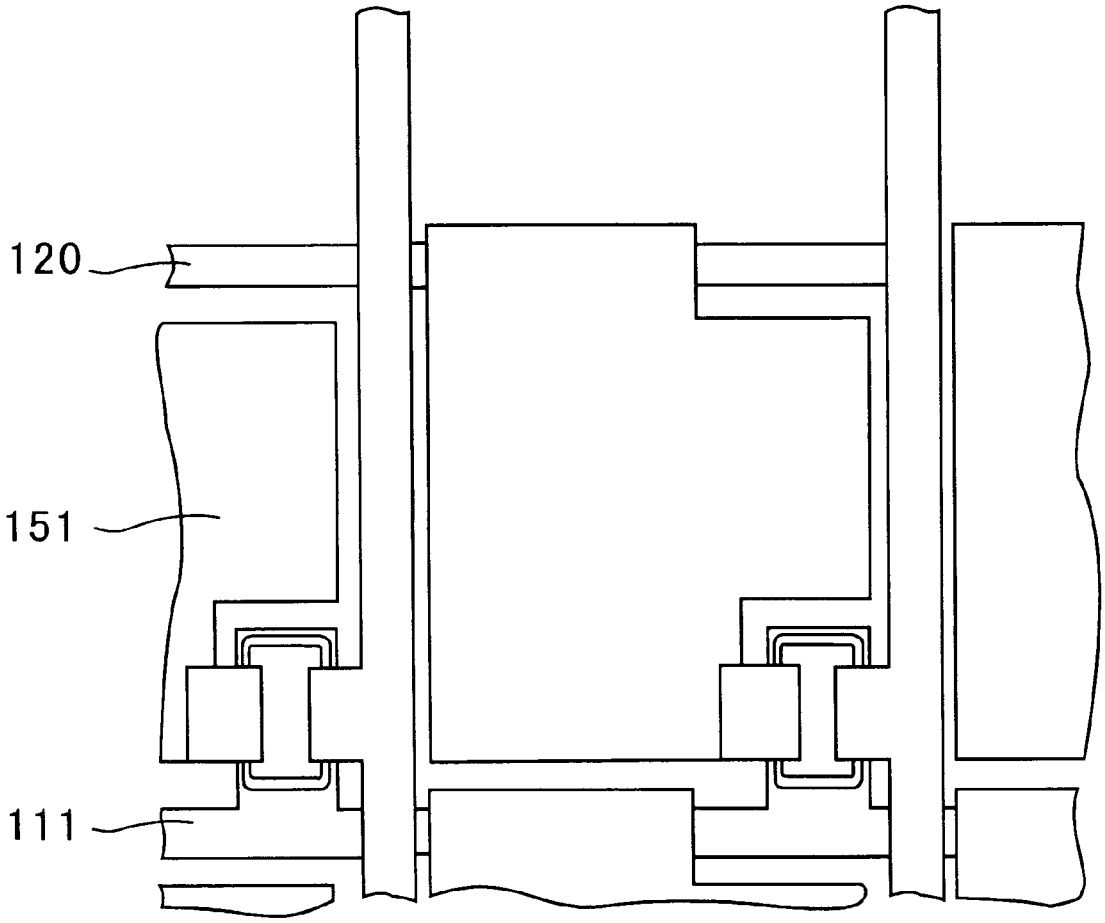
FIG. 4 is a partial plan view to depict a layout of a dummy scanning line disposed on an array substrate in the AM LCD according to the invention.

FIG. 4 shows an electrically conductive dummy scanning line 120 disposed in parallel with the 1st scanning line 111 at the upper portion thereof, provided, however, that a scanning operation on a display screen is performed from the top row ordinary scanning line to the bottom. The dummy scanning line 120 is not connected to the TFT. There are first and second groups of pixel electrodes. The first group of pixels electrodes define ordinary storage capacitors with the ordinary scanning lines. The first group of pixel electrodes are provided in the effective display screen. The second group of pixel electrodes, however, are disposed at the top row and are connected to the 1st row ordinary scanning line through the TFTs. Further, the second group of pixel electrodes define additional storage capacitors with the dummy scanning line.

The counter substrate (not shown) includes color filters disposed on a glass plate and a counter electrode made of ITO formed on the color filters. Light blocking layers made of chromium are provided in the color filters to prevent incident light from coming from the TFTs 121 of the array substrate 100, gaps between the pixel electrodes 151 and the signal lines 103, and gaps between the pixel lines 151 and the scanning lines 111. A series of three primary red, green and blue colors is also disposed between the light blocking layers in the color filters.

Figure 3:
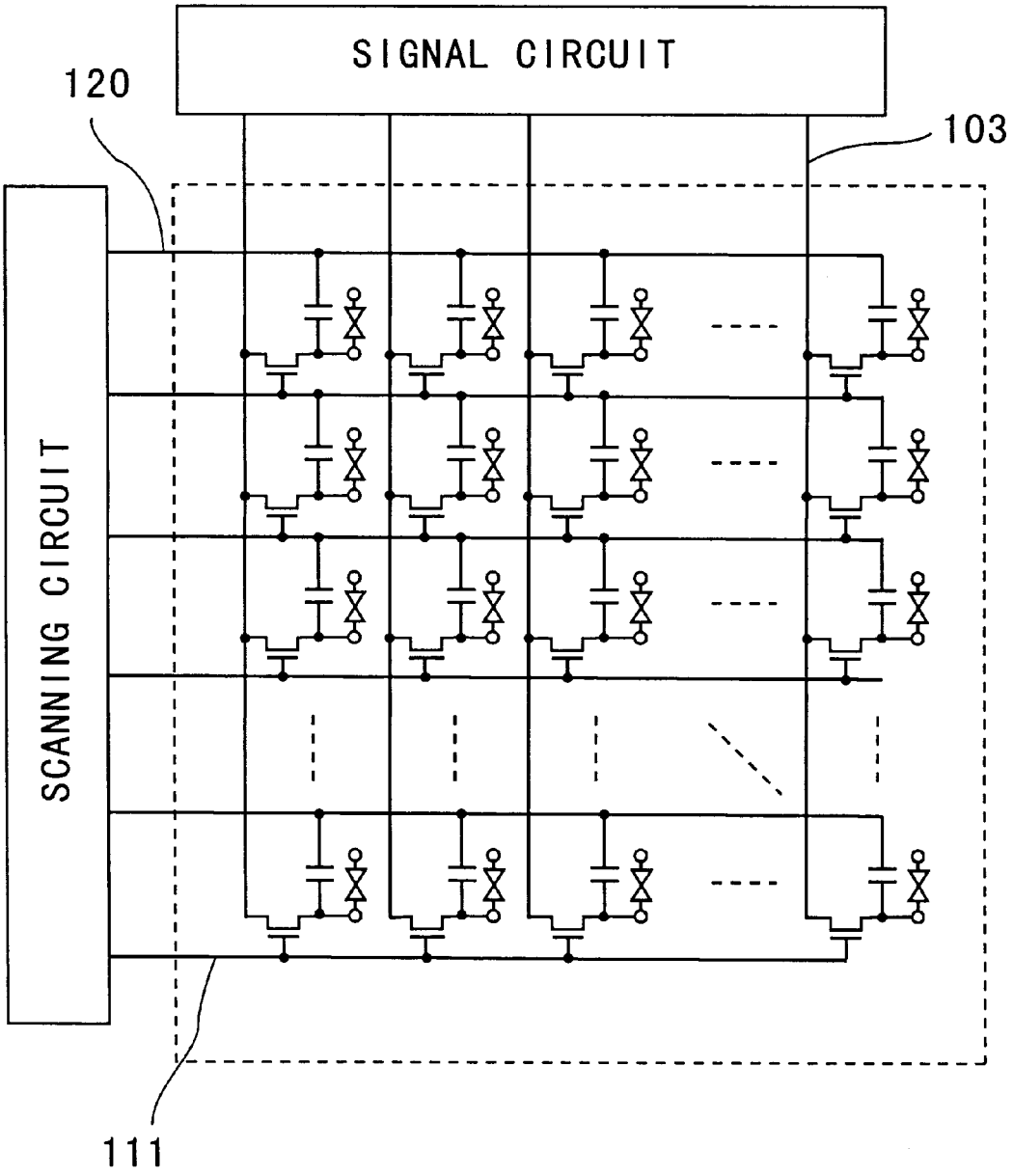
FIG. 3 illustrates schematically an equivalent circuit of an AM LCD according to the invention.

FIG. 3 indicates a schematic equivalent circuit of the AM LCD. The signal line 103 and the scanning lines 111 are connected to signal and scanning circuits in a driver circuit board, respectively, through tape carrier packages. Driving voltages are supplied to the signal and scanning circuits to drive the display screen.

Next, a driving method of the AM LCD will be explained with reference to FIG. 2. The driving method of this embodiment adapts the pixel inversion drive for the signal lines and the punching-through voltage compensation drive for the scanning lines. Driving voltages, thus, reverse in polarity every horizontal scanning line and every adjacent signal line. The punching-through voltage compensation drive provides, during the turning-off period of the switching element, the scanning line with a compensation pulse signal to compensate for pixel potential fluctuations caused at the time when the switching element changes from a turning-on state to the turning-off.

A gray raster display pattern, for example, is described hereinafter. Dotted lines in FIG. 2(*a*) denote a driving signal waveform Vsig(m) supplied to the m-th column signal line while solid lines denote a potential waveform Vp1 at the 1st row and m-th column pixel. This pixel electrode is connected between the m-th column signal line and the 1st row ordinary scanning line through the TFT. The second group of pixel electrodes connected to the 1st row ordinary scanning line through the TFTs define the additional storage capacitors with the dummy scanning line.

Figure 2:
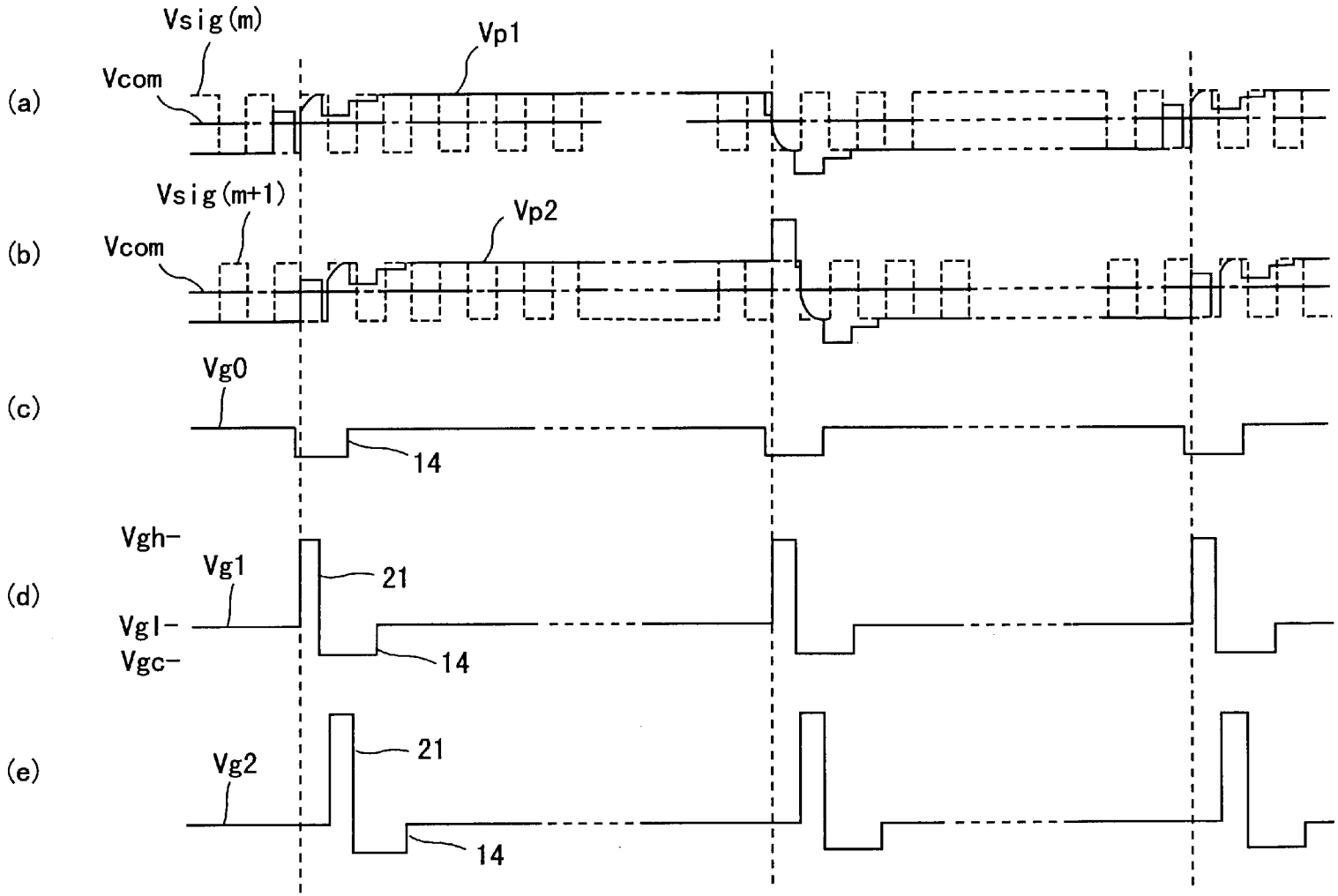
FIG. 2 shows waveforms of a driving method of an AM LCD according to a first embodiment of the invention.

Dotted lines in FIG. 2(*b*) show a driving waveform Vsig(m+1) of a scanning signal supplied to the (m+1)-th column signal line while solid lines show a potential waveform Vp2 at the 2nd row and (m+1)-th column pixel electrode. This pixel electrode is connected between the (m+1)-th column signal line and the 2nd row ordinary scanning line through the TFT. The first group of pixel electrodes connected to the 2nd row ordinary scanning line through the TFTs define the ordinary storage capacitors with the 1st row ordinary scanning line. Dotted and dashed lines in FIGS. 2(*a*) and 2(*b*) indicate a potential waveform Vcom at the counter electrode. Due to effects of the punching-through compensation drive, the center value Vsigc (not shown) of the driving waveform Vsig for the signal lines is substantially equal to the potential Vcom.

Solid lines in FIGS. 2(*a*) through 2(*e*) show driving waveforms Vg0, Vg1 and Vg2 of scanning signals supplied to the dummy, 1st and 2nd row ordinary scanning lines, respectively. The driving voltage Vgh (the potential at the scanning line, i.e., the writing voltage) to turn the TFT on, the voltage to turn it off, the compensation voltage, and the common potential at the counter electrode are Vgh=23(V), Vgl=−6(V), Vge=−10(V), and Vcom=5(V), respectively.

The driving waveform Vg0 of the scanning signal supplied to the dummy scanning line is only a compensation pulse 14. The driving waveforms Vg1 and Vg2 of the scanning signals supplied to the 1st and 2nd row ordinary scanning lines, respectively, include the scanning pulses 21 and the compensation pulses 14 as shown in FIGS. 2(*d*) and 2(*e*), for instance. The potential waveform Vp1 at the 1st row and m-th column pixel electrode, i.e., the pixel electrode connected to the 1st row ordinary scanning line, is indicated by the solid lines in FIG. 2(*a*). The potential waveform Vp2 at the pixel electrode lower than the 1st row ordinary scanning line, e.g., the 2nd row and (m+1)-th column pixel electrode, is indicated by the solid lines in FIG. 2(*b*).

Figure 11:
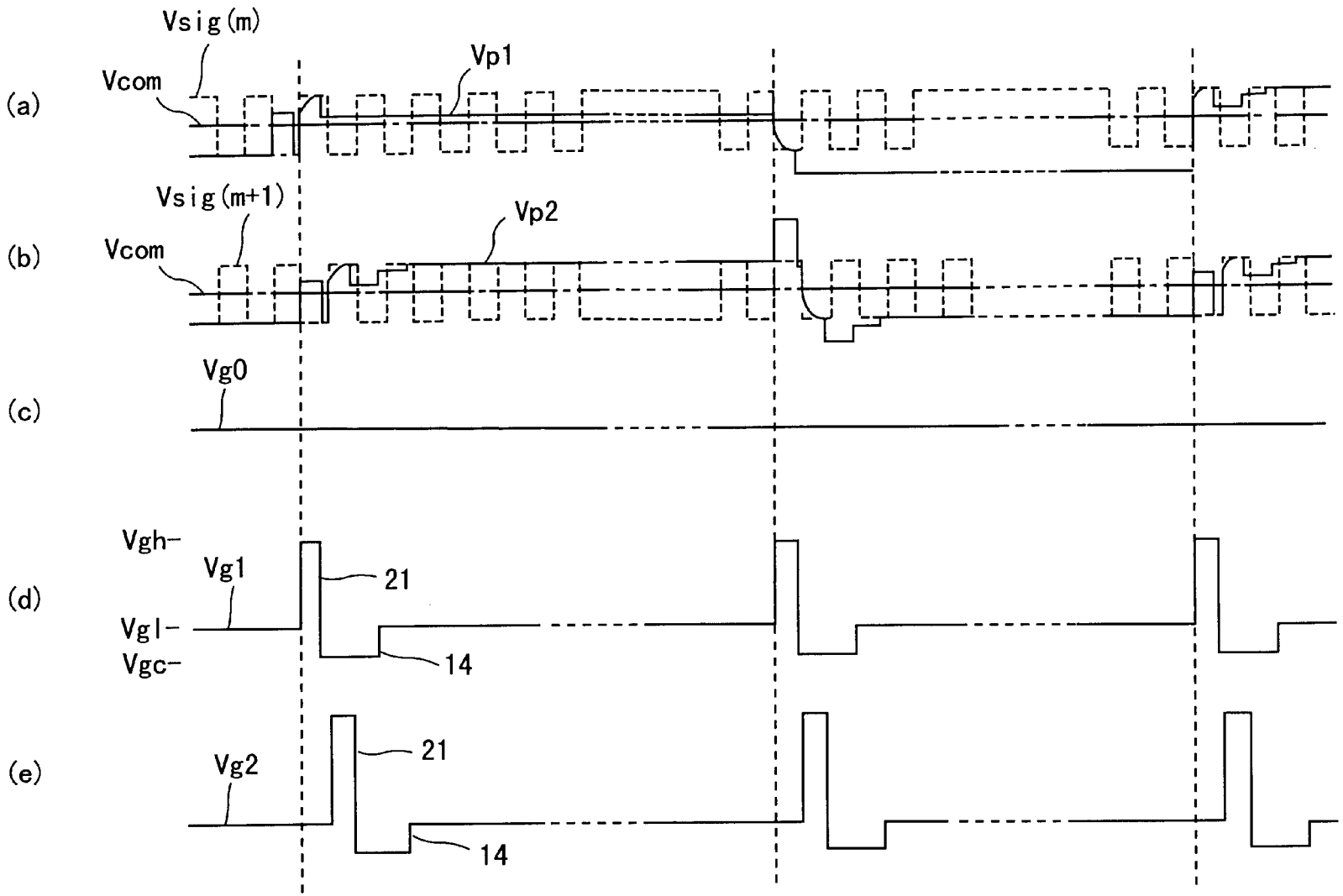
FIG. 11 is waveforms of a conventional driving method of an AM LCD.

The driving method of this embodiment will be hereinafter compared with a conventional driving method of an AM LCD shown in FIG. 11. Driving waveforms illustrated in FIG. 11 are applied to an AM LCD in which the dummy scanning line is disposed at the top row and defines the additional storage capacitors with the pixel electrodes at the top row. The pixel inversion drive is adapted so that the polarity of voltages provided to the pixels is reversed with respect to a reference potential every horizontal scanning period and every signal line. The punching-through voltage compensation drive is also used in the driving method.

Dotted lines in FIG. 11(*a*) depict a driving waveform Vsig(m) applied to the m-th column signal line. Solid lines in FIG. 11(*a*) represent a potential waveform Vp1 at the 1st row and m-th column pixel. This pixel is connected to the m-th column signal line and the 1st ordinary scanning line through the TFT. The pixel electrodes connected to the 1st ordinary scanning line define the additional storage capacitors with the dummy scanning line and the insulation layer. Dotted and dashed lines in FIG. 11(*a*) show a potential waveform Vcom at the counter electrode.

Dotted lines in FIG. 11(*b*) indicate a driving signal waveform Vsig(m+1) supplied to the (m+1)-th column. The solid lines in FIG. 2(*b*) show the potential waveform Vp2 at the 2nd row and (m+1)-th pixel electrode. This pixel electrode is connected to the (m+1)-th column signal line and the 2nd row ordinary scanning line. The pixel electrodes connected to the 2nd row ordinary scanning line through the TFTs define the ordinary storage capacitors with the 1st ordinary scanning line and the insulation layer. Dotted and dashed lines in FIG. 11(*b*) indicate a potential waveform Vcom at the counter electrode.

Solid lines in FIG. 11(*c*) show a scanning signal driving waveform Vgo of a D.C. component supplied to the dummy scanning line. Solid lines in FIGS. 11(*d*) and 11(*e*) are scanning signal driving waveforms Vg1 and Vg2 provided to the 1st and 2nd row ordinary scanning lines, respectively. The driving waveforms are composed of scanning pulses 21 to turn the switching elements on and compensation pulses 14.

Since the potential supplied between the pixel electrode connected to the 1st row ordinary scanning line and the dummy scanning line is only the D.C. component, it does not compensate for fluctuations caused at the time when the switching element changes from the turning-on state to the turning-off. Thus, the pixel electrode potentials on the positive and negative polarity sides of the frames are asymmetric with respect to the counter electrode potential (common electrode potential) as shown in FIGS. 11(*a*) and 11(*b*). As a consequence, the positive polarity side potential provided to the liquid crystal is different from the negative polarity side one. Such potential difference causes flickers on the display screen at the pixel electrodes connected to the 1st row ordinary scanning line and uneven brightness on the display screen at the pixel electrodes connected to the 2nd and subsequent ordinary scanning lines.

According to the first embodiment driving method of the present invention, however, the scanning signals including the compensation pulses are provided to both the ordinary and dummy scanning lines. Thus, it compensates for the potential fluctuations caused at the second group of pixel electrodes at the time when the switching element changes from the turning-on state to the turning-off. The pixel electrode potentials on the positive and negative polarity sides can be symmetry with respect to the common pixel electrode potential. As a result, the flickers and uneven brightness on the display screen can be substantially reduced.

In other words, application of the compensation pulse to the ordinary scanning line as well as the dummy scanning line makes the optimum common voltage at the region of the second group of pixel electrodes substantially equal to that at the other region of first group of pixel electrodes. Thus, an entire display on the screen becomes uniform in brightness.

The driving method to compensate for the punching-through voltage according to the present invention is applied to the AM LCD which includes ordinary storage capacitors defined by the first group of pixel electrodes, the ordinary scanning lines and the insulation layer, and additional storage capacitors defined by the second group of pixel electrodes, the dummy scanning line, and the insulation layer. The compensation pulse is provided to the ordinary and dummy scanning lines so that a uniform brightness display can appear on the screen.

An AM LCD in accordance with a second embodiment of the invention will be explained hereinafter. In addition to such a compensation pulse as in the first embodiment, a scanning pulse is also applied to the dummy scanning line in this embodiment.

The AM LCD is a normally white type light transmission display device. This display device includes array and counter substrates, alignment layers provided on the substrates, respectively, to face each other, a gap defined between the alignment layers, a liquid crystal layer disposed in the gap, and two sheets of polarlizers respectively provided on the outer surfaces of the substrates.

FIGS. 5 and 6 show the structure of the array substrate. FIG. 5 is a partial plan view of the array substrate 100 while FIG. 6 is a sectional view taken along the line VI-VI' thereof.

The array substrate 100 includes (1,024×3) signal lines 103 and 768 scanning lines 111 crossing the signal lines 103 at substantially right angles. The scanning lines 111 are directly formed on a glass substrate 101 and a gate insulation layer 113 made of silicon oxide covers the scanning liens 111 and the glass plate 101. The signal lines 103 are disposed on the gate insulation layer 113. TFTs 121 are formed in the vicinities of the cross points of the signal lines 103 and the scanning lines 111 as switching elements. Pixel electrodes 151 made of ITO are provided to connect the TFTs 121.

A lamination structure of the TFT 121 includes a gate electrode 112 extending from the scanning line 111, the gate insulation layer 113, a gate silicon nitride 114, an a-Si semiconductor layer 115, and a channel protection layer 117 made of silicon nitride. The structure further includes a low resistance semiconductor layer 119 made of n+ a-Si, a source electrode 131 connected to the pixel electrode 151*a* and a drain electrode 132 connected to the signal line 103. As shown in FIG. 5, a first group of pixel electrodes 151*a* connected to the n-th row ordinary scanning line 111, ($n \neq 1$), through the TFTs 121 define ordinary storage capacitors with the (n−1)-th row ordinary scanning line 111.

FIG. 4 shows an electrically conductive dummy scanning line 120 disposed in parallel with the 1st scanning line 111 at the upper portion thereof, provided, however, that a scanning operation on a display screen is performed from the top row ordinary scanning line to the bottom. The dummy scanning line 120 is not connected to the TFT.

The counter substrate (not shown) includes color filters disposed on a glass plate and a counter electrode made of ITO formed on the color filters. Light blocking layers made of chromium are provided in the color filters to prevent incident light from coming from the TFTs 121 of the array substrate 100, gaps between the pixel electrodes 151 and the signal lines 103, and gaps between the pixel lines 151 and the scanning lines 111. A series of three primary red, green and blue colors is also disposed between the light blocking layers in the color filters.

FIG. 3 indicates a schematic equivalent circuit of the AM LCD. The signal lines 103 and the scanning lines 111 are connected to signal and scanning circuits in a driver circuit board, respectively, through tape carrier packages. Driving voltages are supplied to the signal and scanning circuits to drive the display screen.

Next, a second driving method of the AM LCD will be explained with reference to FIGS. 1 and 2 which indicate the driving methods in accordance with the first and second embodiments, respectively. The driving methods adapt the pixel inversion drive for the signal lines and the punching-through voltage compensation drive for the scanning lines. Driving voltages, thus, reverse in polarity every horizontal scanning line and every adjacent signal line.

A gray raster display pattern, for example, is described hereinafter. Dotted lines in FIGS. 1(*a*) and 2(*a*) denote a driving signal waveform Vsig(m) supplied to the m-th column signal line while solid lines therein denote a potential waveform Vp1 at the 1st row and m-th column pixel. This pixel electrode is connected between the m-th column signal line and the 1st row ordinary scanning line through the TFT. The second group of pixel electrodes connected to the 1st row ordinary scanning line through the TFTs define the additional storage capacitors with the dummy scanning line.

Figure 1:
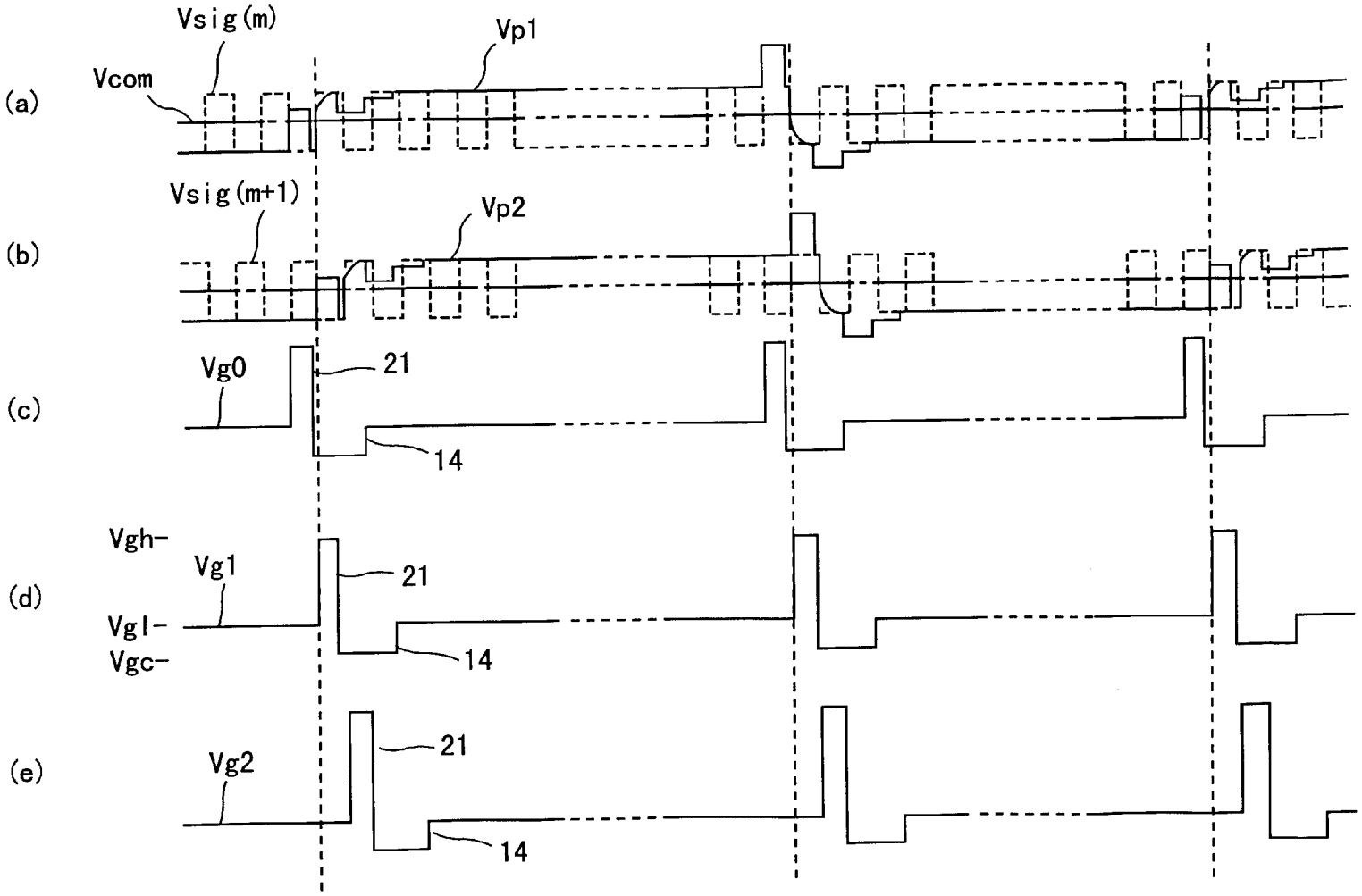
FIG. 1 shows waveforms of a driving method of an AM LCD according to a second embodiment of the present invention.

Dotted lines in FIGS. 1(*b*) and 2(*b*) show a driving waveform Vsig(m+1) of a scanning signal supplied to the (m+1)-th column signal line while solid lines therein a potential waveform Vp2 at the 2nd row and (m+1)-th column pixel electrode. This pixel electrode is connected between the (m+1)-th column signal line and the 2nd row ordinary scanning line through the TFT. The pixel electrodes connected to the 2nd row ordinary scanning line through the TFTs define the ordinary storage capacitors with the 1st row ordinary scanning line.

Solid lines in FIGS. 1(*c*) and 2(*c*), 1(*d*) and 2(*d*), and 1(*e*) and 2(*e*) indicate driving waveforms Vg0, Vg1 and Vg2 or scanning signals supplied to the dummy scanning line, and the 1st and 2nd row ordinary scanning lines, respectively. Dotted and dashed lines in FIGS. 1(*a*) and 1(*b*), and 2(*a*) and 2(*b*) indicate a common potential waveform Vcom at the counter electrode. Due to the effects of the punching-through compensation drive, the center value Vsigc (not shown) of the driving waveform Vsig for the signal line is substantially equal to the potential Vcom. The driving voltage Vgh (the potential at the scanning line, i.e., the writing voltage) to turn the TFT on, the voltage to turn it off, the compensation voltage, and the common potential at the counter electrode are Vgh=23(V), Vgl=−6(V), Vge=−10(V), and Vcom=5(V), respectively.

With reference to FIG. 2, the first driving method will be explained again for better understanding of the second one. The driving waveform Vg0 of the scanning signal supplied to the dummy scanning line is not any pulse to turn the TFT on but only a compensation pulse 14 because the dummy scanning line is not connected to the TFT. Further, the driving waveform of the scanning signal provided to the ordinary scanning line includes the scanning pulse 21 to turn the TFT on and the compensation pulse 14 as illustrated in FIGS. 2(*d*) and 2(*e*). The solid lines in FIG. 2(*a*) show the potential waveform Vp1 at the pixel electrode connected to the 1st row ordinary scanning line, i.e., the 1st row and m-th column pixel electrode to define the storage capacitor with the dummy scanning line and the insulation layer. The potential waveform Vp2 at the pixel electrodes connected to lower scanning lines than the 1st row ordinary scanning line, e.g., the 2nd row and (m+1)-th column pixel electrode, is indicated by the solid lines in FIG. 2(*b*). The potential Vp2 is different from the Vp1 at the 1st row and m-th column electrode. This potential waveform difference is caused by the fact that any signal corresponding to the scanning pulse is not provided to the dummy scanning line. The effective voltage at the pixel electrodes to define the additional storage capacitors with the dummy scanning line and the insulation layer becomes smaller by the one corresponding to such a voltage without the scanning pulse than that at the other pixel electrodes. As a result, so far as the normally white mode is used for display, the brightness in the region connected to the 1st row ordinary scanning line is much brighter in comparison with that in the other region connected to the lower scanning lines than the 1st row ordinary scanning line. The compensation pulse is an input voltage pulse supplied to the ordinary and dummy scanning lines during the turning-off period of the switching element to compensate for pixel potential fluctuations caused at the time when a change from a turn-on state to the turn-off takes place with the switching element.

The potential waveform Vg0 for the dummy scanning line in the second embodiment driving method, on the other hand, includes not only the compensation pulse 14 but also the scanning pulse 21 to turn the TFT on as in the potential waveforms for the 1st and 2nd scanning lines shown in FIGS. 1(*d*) and 1(*e*). As a consequence, the potential waveform Vp1 indicated by the solid lines in FIG. 1(*a*) becomes similar to the waveform Vp2 illustrated by the solid lines in FIG. 1(*b*). The former is the potential at the 1st row and m-th column pixel electrode connected to the 1st scanning line. The latter is the potential at the pixel electrode connected to the lower scanning line than the 1st, e.g., at the 2nd row and (m+1)-th column pixel electrode. Thus, the effective voltage provided to the liquid crystal corresponding to the pixel electrode to define the storage capacitor with the dummy scanning line becomes equal to that supplied to the liquid crystals corresponding to the other pixel electrodes so that displayed images can be uniform in brightness on the screen. The images displayed on the first embodiment AM LCD are brighter at the top row than the others. The present embodiment AM LCD can provide more entirely uniform images than the first embodiment.

A driving method of an AM LCD in accordance with a third embodiment of the invention will be explained hereinafter with reference to FIG. 7. In the driving method of the second embodiment, two scanning periods are assigned for the compensation during which the comparison pulses are applied to the AM LCD. The compensation in the third embodiment, however, is carried out only during one scanning period (1H). The dummy scanning line in this embodiment is disposed at the top row as in the first embodiment.

The third embodiment driving method adapts such a pixel inversion drive for the signal lines and such a punching-through voltage compensation drive for the scanning lines as in the second embodiment. Dotted lines in FIG. 7 show a driving waveform Vsig(m) of a signal provided to the m-th row signal line. Solid lines therein indicate a potential waveform Vp1 at the 1st row and m-th column pixel electrode. This electrode is connected to the m-th column signal line and 1st row ordinary scanning line through the TFT. The pixel electrodes connected to the 1st row ordinary scanning line through the TFTs define the additional storage capacitors with the dummy scanning line and the insulation layer.

Figure 7:
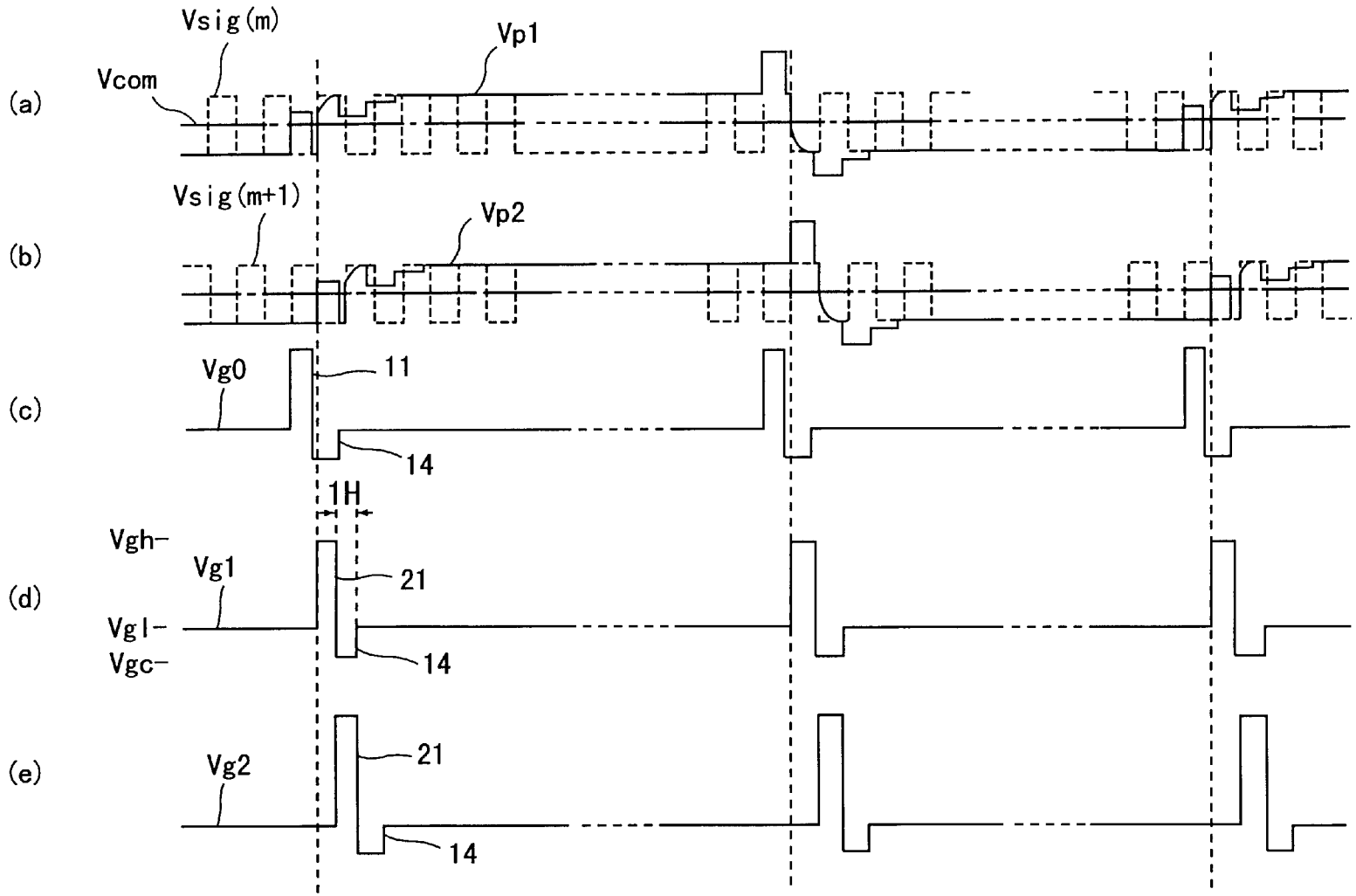
FIG. 7 shows waveforms to explain a driving method of a third embodiment according to the invention.

Dotted lines in FIG. 7(*b*) depict a driving waveform Vsig(m+1) of a signal supplied to the (m+1)-th column signal line. Solid lines therein depict a potential waveform Vp2 at the 2row and (m+1)-th column pixel electrode. This pixel electrode is connected to the (m+1) column signal line and the 2nd row ordinary scanning line through the TFT. The pixel electrodes connected to the 2nd scanning line through the TFTs define the ordinary storage capacitors with the 1st scanning line and the insulation layer. Solid lines in FIGS.

7(*c*), 7(*d*) and 7(*e*) indicate driving waveforms Vg0, Vg1 and Vg2 of scanning signals supplied to the dummy, 1st and 2nd scanning lines, respectively.

The driving waveforms Vg0, Vg1 and Vg2 each include the compensation pulse 14 as well as the scanning pulse 21 to turn the TFT on as in the second embodiment. Contrary to the second embodiment, however, the compensation is performed during one scanning period as shown in FIGS. 7(*c*), 7(*d*) and 7(*e*). The driving waveforms of the signals applies to the dummy and ordinary scanning lines are set to be substantially the same in the driving method of the present embodiment as in that of the second embodiment. Thus, the pixel potential at the pixel electrode connected to the dummy scanning line can be the same as at the pixel electrode connected to the ordinary scanning lines. As a result, the present embodiments can also display uniform brightness images on the screen.

Since the compensation is performed during one scanning period according to the present embodiment, the difference between the optimum common voltages is made smaller for the input and terminal end of the scanning line than in the case of the compensation during two scanning periods. As a result, flickers on the screen can be effectively suppressed. The flickers are caused by the difference between voltages applied to the liquid crystal at each frame with the positive or negative polarity. Usually, in order to suppress the flickers, the optimum common voltage is set to make the voltages applied to the liquid crystal at each frame with the positive or negative polarity substantially the same.

A fourth embodiment of the present invention will be described hereinafter with reference to FIG. 8. This fourth embodiment makes use of a double gate scanning drive which is different from the driving methods of the embodiments explained above. In the double gate drive, preliminary scanning pulses are provided prior to ordinary scanning pulses to turn the TFTs on so that it may overcome the lack of pixel writing potential and reduce the burden imposed on the TFTs. The driving method of the fourth embodiment adapts the pixel inversion drive for the signal line and the punching-through voltage compensation drive for the scanning lines. The dummy scanning line is provided at the top row as in the embodiments described above.

Figure 8:
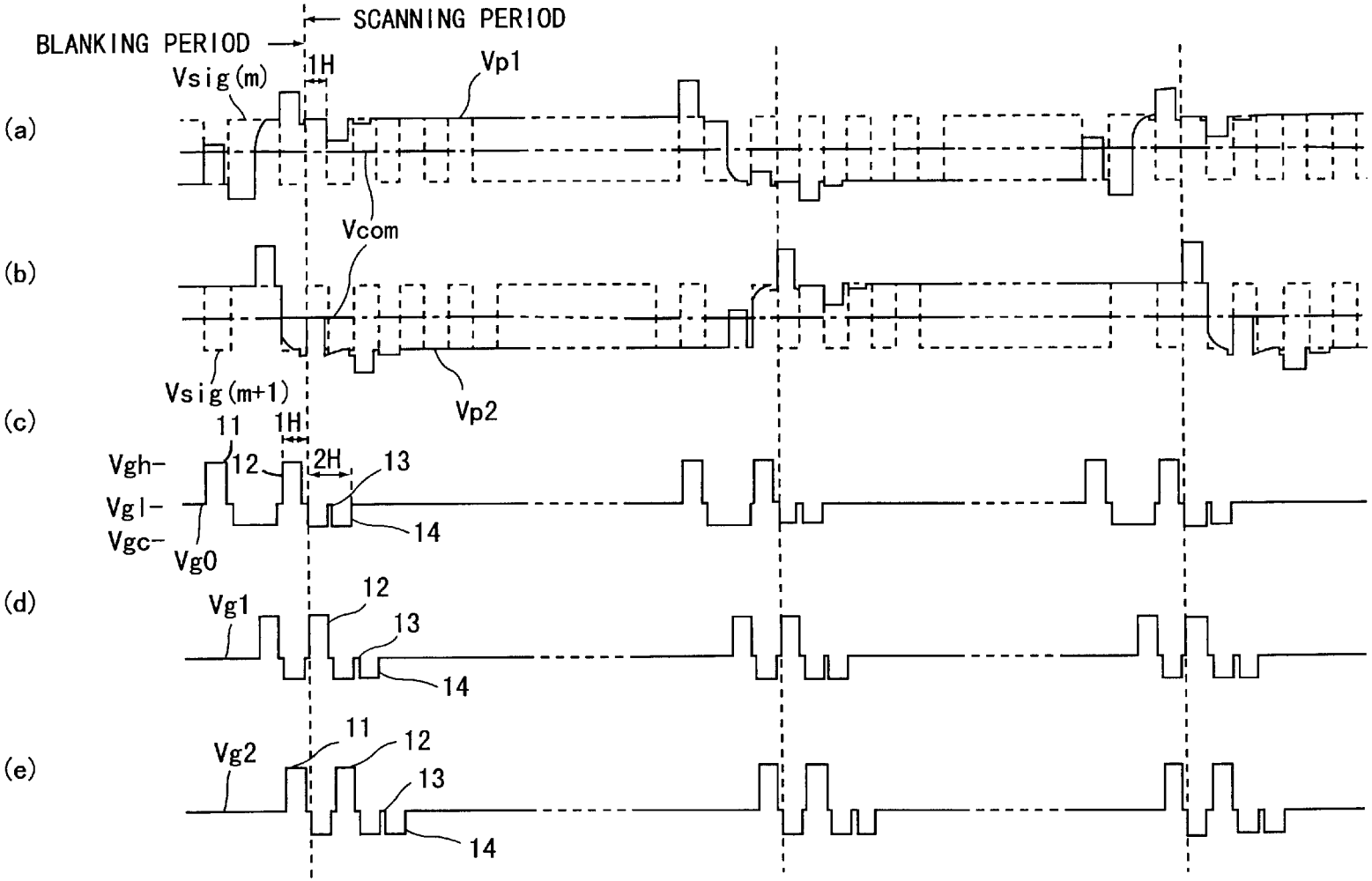
FIG. 8 shows waveforms to explain a driving method of a fourth embodiment according to the invention.

Dotted lines in FIGS. 8(*a*) and 8(*b*) show driving waveforms of signals applied to the m-th and (m+1)-th signal lines, respectively. Dotted and dashed lines therein are potential waveforms Vcom applied to the counter electrode. A waveform Vp1 in FIG. 8(*a*) denotes a potential at the 1st row and m-th column pixel electrode connected to the 1st row ordinary scanning line and the m-th column signal line through the TFT. The pixel electrodes connected to the 1st row ordinary scanning lines through the TFTs define the additional storage capacitors with the dummy scanning line and the insulation layer.

Driving waveforms Vg0, Vg1 and Vg2 in FIGS. 8(*c*), 8(*d*) and 8(*e*) are signals applied to the dummy scanning line, and the 1st and 2nd row ordinary scanning lines, respectively. Further, reference numerals 12, 13 and 14 therein are preliminary scanning, ordinary scanning, auxiliary and compensation pulses, respectively. The compensation pulses 14 are applied to the dummy scanning line as well as each scanning line during two scanning periods (2H) for compensation. It is necessary for the preliminary pulse 11 to be applied during such a scanning period that a driving pulse is applied with the same polarity as the driving pulse applied to the signal line when the ordinary scanning pulse 12 is applied. Since the pixel inversion drive is used in this embodiment, the driving signal applied to the signal line changes from the positive to negative polarity every scanning line and every column in the frame. Thus, the preliminary pulses 11 is applied two scanning periods in advance of the ordinary scanning pulses 12 as shown in FIGS. 8(*d*) and 8(*e*). The preliminary pulse 11 applied to the dummy scanning line is provided three scanning periods in advance of the ordinary scanning pulse 12 as shown in FIG. 8(*c*) and its explanation will be made in detail later on. The auxiliary pulses 13 are applied during the period of the compensation pulses 14. When the ordinary scanning pulse applied to the 1st row ordinary scanning line, for instance, turns off (as in FIG. 8(*d*)), the auxiliary pulse 13 is applied to the dummy scanning line (as in FIG. 8(*c*)). Such application of the auxiliary pulse results in smaller difference between the optimum common voltages on the voltage input and termination sides of one scanning line than without auxiliary pulse. As a result, flickers can be suppressed on the screen. A change of the compensation from two scanning periods to one as in the second embodiment without application of the auxiliary pulse 13 may also suppress the flickers on the screen.

As shown in FIG. 8(*a*), for instance, the driving waveform of a signal supplied to the signal line has blanking and scanning periods during one frame period and the polarity thereof basically changes every scanning period. Same polarity pulses are applied during two successive scanning periods in the blanking period as also shown in FIG. 8(*a*). Application of those pulses is necessary for an even number of scanning lines and the pixel inversion drive. It is merely because a voltage polarity applied to a liquid crystal at a pixel must be alternatively changed from one frame to another. Where the number of the scanning lines is even, the same polarity pulses are applied during two successive scanning periods in the blanking period to invert the polarity in the following frame as shown in FIG. 8(*a*). Those two same polarity pulses are also used for one scanning period inversion drive. As already set forth above, it is necessary for the preliminary scanning pulse to be applied during such a scanning period that a driving pulse is applied in accordance with the same polarity as the driving pulse applied to the signal line when the ordinary scanning pulse is provided. The preliminary and ordinary scanning pulses are applied to the dummy scanning line in the blanking period so that the preliminary pulse is applied three scanning periods in advance of the ordinary scanning pulse in the blanking period in which the same polarity pulses are applied during the two successive scanning periods as shown in FIG. 8(*b*).

The driving waveform of the signal applied to the dummy scanning line is not identical to that applied to an ordinary scanning line in the double gate scanning drive of the present embodiment. Application of the scanning and compensation pulses to the dummy and ordinary scanning lines makes the pixel potential at the pixel electrodes connected to the 1st row ordinary scanning line substantially the same as that at the pixel electrodes connected to the 2nd row ordinary scanning line. As a result, the AM LCD can display uniform brightness images on the screen.

Figure 9:
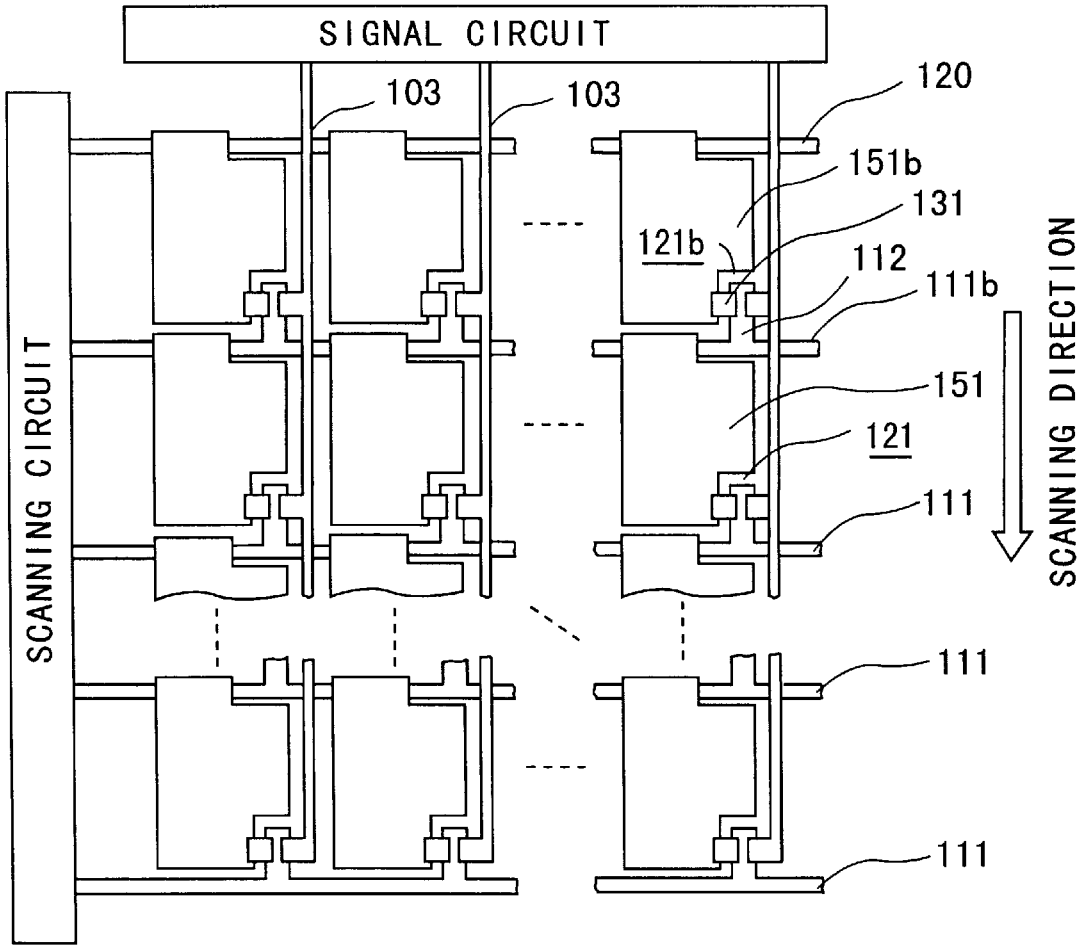
FIG. 9 is a schematic plan view to show the wiring structure of the AM LCD of the first through fourth embodiments according to the invention.
Figure 10:
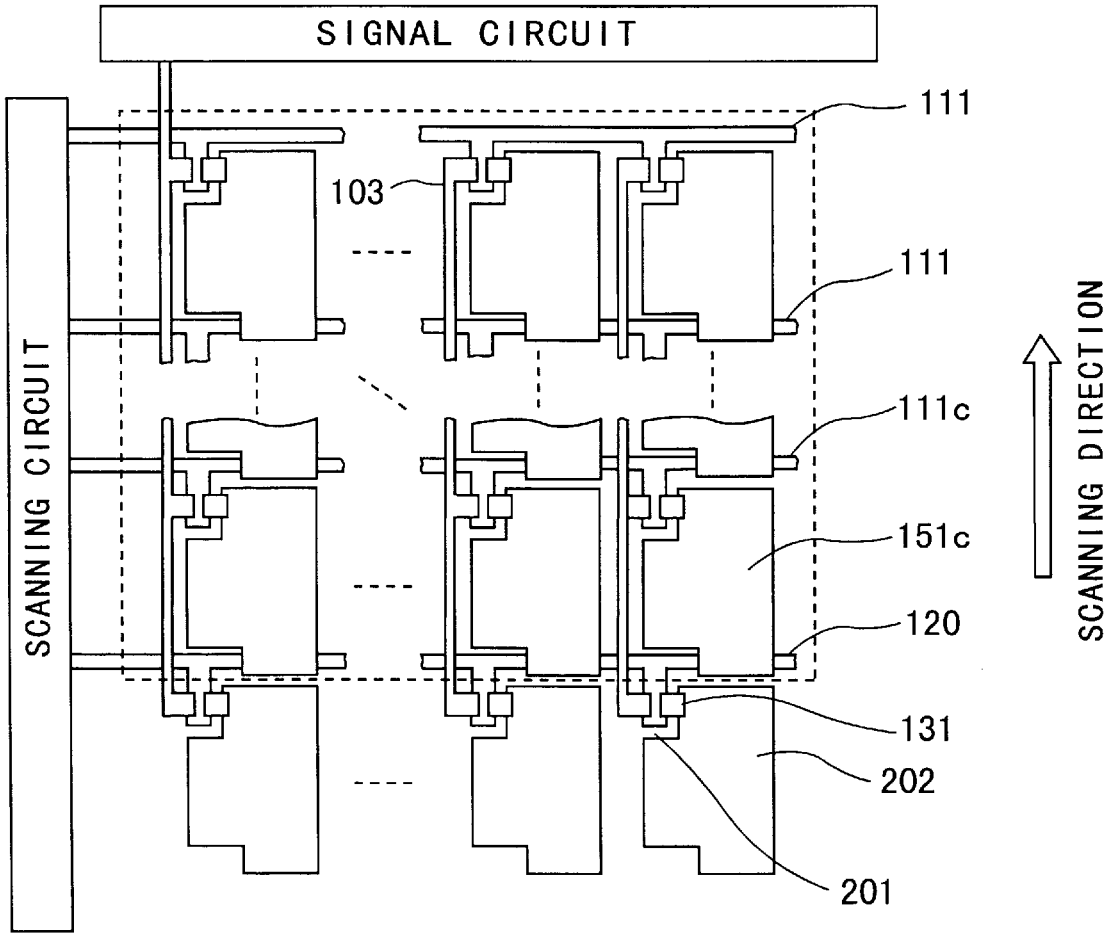
FIG. 10 is a schematic structural view to explain the other wiring structure of the AM LCD according to the invention.

As shown in FIG. 9, the AM LCD includes the signal lines 103, the scanning lines 111, the gate lines 112, the pixel electrodes 151, the TFTs 121 and the dummy scanning line 120. The AM LCD scans from the upper portion of the screen to the lower portion in which the dummy scanning line 120 is disposed to define the additional storage capacitors with the pixel electrodes 151*b* connected to the top scanning line 111*b* through the TFTs 121*b*. This invention is not limited thereto but applicable to other AM LCDs. As shown in FIG. 10, for example, the AM LCD scans from the bottom portion of the screen to the upper portion in which the dummy scanning line 120 may be disposed lower than the bottom scanning line 111*c* and define the additional storage capacitors with the pixel electrodes 151*c* connected to the bottom scanning line 111*c* through the TFTs 121*c*.

In the embodiments mentioned above, the dummy scanning line is not connected to the pixel electrodes through the TFTs. As shown in FIG. 10, however, the dummy scanning line 120 may be connected to dummy pixel electrodes 202 through the dummy TFTs 201 as the ordinary scanning lines 111 and 111*c*, provided that the dummy pixel electrodes 202 are not used for an image display.

FIGS. 9 and 10 show schematically the AM LCDs in which the dummy scanning lines are disposed as conductive lead lines at the upper portion of the screen or the lower portion thereof, respectively, but either a channel protection layer or a semiconductor layer provided for the switching element is not shown for the sake of simplification. FIG. 10 depicts the ordinary display region surrounded by dotted lines and the other non-display region including the dummy scanning line, the dummy switching element and the dummy pixel electrodes.

The driving methods of this invention are characterized in that the compensation pulses are applied to the ordinary scanning lines as well as the dummy scanning line of the AM LCD in which the pixel electrodes define the ordinary storage capacitors with the ordinary scanning lines connected to the first group of pixel electrodes through the TFTs and the insulation layer, and the dummy scanning line also defines the additional storage capacitors with the second group of pixel electrodes.

The driving methods of this invention are further characterized in that the scanning pulses and the compensation pulses are applied to not only the ordinary scanning lines but also the dummy scanning line of the AM LCD in which the first group of pixel electrodes define the ordinary storage capacitors with the ordinary scanning lines connected to the pixel electrodes through the TFTs and the insulation layer, and the dummy scanning line also defines the additional storage capacitors with the second group of pixel electrodes.

According to the present invention, the scanning pulses include the compensation pulses applied to the ordinary and dummy scanning lines so that the optimum common voltage for the pixel electrodes connected to the ordinary scanning line can be set to be substantially the same as for the pixel electrode associated with the dummy scanning line. As a result, uniform brightness images are displayed on the screen and display dignity can be improved.

In addition, the driving methods of the present invention apply the scanning pulses and the compensation pulses to the ordinary and dummy scanning lines so that the effective voltages applied to the liquid crystals in the pixel electrode region and the brightness of the pixels become substantially equal. As a result, uniform brightness images are displayed on the screen and display dignity can be improved.

What we claim is:

1. A driving method of an active-matrix type liquid crystal display device including a plurality of ordinary scanning lines, a dummy scanning line, a plurality of signal lines crossing said ordinary and dummy scanning lines to form cross points, switching elements disposed in the vicinities of the cross points, first and second groups of pixel electrodes connected to said switching elements, counter electrodes provided opposite to said first and second groups of pixel electrodes, liquid crystals controlled in accordance with potential differences between said pixel and counter electrodes, ordinary storage capacitors defined by said first group of pixel electrodes and said ordinary scanning lines, and additional storage capacitors defined by said second group of pixel electrodes and said dummy scanning line:

applying scanning pulses to said ordinary scanning lines to turn on said switching elements;

applying compensation pulses to said ordinary scanning lines to compensate for potential fluctuations at said pixel electrodes caused at the time when said switching elements change in state;

storing video signals to be provided to said signal lines in said ordinary storage capacitors in response to operations of said switching elements; and applying said compensation pulses to said dummy scanning line.

2. A driving method of an active-matrix type liquid crystal display device including a plurality of ordinary scanning lines, a dummy scanning line, a plurality of signal lines crossing said ordinary and dummy scanning lines to form cross points, switching elements disposed in the vicinities of the cross points, first and second groups of pixel electrodes connected to said switching elements, counter electrode provided opposite to said first and second groups of pixel electrode, liquid crystals controlled in accordance with potential differences between said pixel and counter electrodes, ordinary storage capacitors defined by said first group of pixel electrodes and said ordinary scanning lines, and additional storage capacitors defined by said second group of pixel electrodes and said dummy scanning line:

applying scanning pulses to said ordinary scanning lines to turn on said switching elements;

applying compensation pulses to said ordinary scanning lines to compensate for potential fluctuations at said pixel electrodes caused at the time when said switching elements change in state;

storing video signals in said ordinary storage capacitors in response to operations of said switching elements; and applying said scanning pulses and said compensation pulses to said dummy scanning line.

3. The driving method of an active-matrix type liquid crystal display device according to claim 1, wherein scanning operations are performed from the top of said active-matrix type liquid crystal display device to the bottom thereof, and said dummy scanning line is disposed at a higher position than the top of said ordinary scanning lines.

4. The driving method of an active-matrix type liquid crystal display device according to claim 2, wherein scanning operations are performed from the top of said active-matrix type liquid crystal display device to the bottom thereof, and said dummy scanning line is disposed at a higher position than the top of said ordinary scanning lines.

5. The driving method of an active-matrix type liquid crystal display device according to claim 1, wherein scanning operations are performed from the bottom of said active-matrix type liquid crystal display device to the top thereof, and said dummy scanning line is disposed at a lower position than the bottom of said ordinary scanning lines.

6. The driving method of an active-matrix type liquid crystal display device according to claim 2, wherein scanning operations are performed form the bottom of said active-matrix type liquid crystal display device to the top thereof, and said dummy scanning line is disposed at a lower position than the bottom of said ordinary scanning lines.

7. The driving method of an active-matrix type liquid crystal display device according to claim 2, wherein waveforms of said scanning and compensation pulses applied to said ordinary scanning lines are substantially the same as to said dummy scanning line.

8. The driving method of an active-matrix type liquid crystal display device according to claim 1, said liquid crystal display device further including dummy pixel electrodes connected to said dummy scanning line through said switching elements, said dummy pixel electrodes being disposed at a region other than a display region of said liquid crystal display device.

9. The driving method of an active-matrix type liquid crystal display device according to claim 2, said liquid crystal display device further including dummy pixel electrodes connected to said dummy scanning line through said switching elements, said dummy pixel electrodes being disposed at a region other than a display region of said liquid crystal display device.

10. The driving method of an active-matrix type liquid crystal display device according to claim 1, wherein said dummy scanning line is not connected to either said switching element or said pixel electrodes connected to said switching elements.

11. The driving method of an active-matrix type liquid crystal display device according to claim 2, wherein said dummy scanning line is not connected to either said switching element or said pixel electrodes connected to said switching elements.

12. A driving method of an active-matrix type liquid crystal display device including a plurality of ordinary scanning lines disposed in the row direction, a dummy scanning line, a plurality of signal lines provided in the column direction, said signal lines crossing said ordinary and dummy scanning lines to form cross points, switching elements disposed in the vicinities of the cross points, first and second groups of pixel electrodes connected to said switching elements, said second group of electrodes being disposed at a higher position than the top row of said first group of pixel electrodes or at a lower position than the bottom row of said second group of pixel electrodes, counter electrodes provided opposite to said first and second groups of pixel electrodes, liquid crystals controlled in accordance with potential differences between said pixel and counter electrodes, ordinary storage capacitors defined by said first group of pixel electrodes and said ordinary scanning lines, and additional storage capacitors defined by said second group of pixel electrodes and said dummy scanning line:

applying scanning pulses to said ordinary scanning lines to turn on said switching elements;

applying compensation pulses to said ordinary scanning lines to compensate for potential fluctuations at said pixel electrodes caused at the time when said switching elements change in state;

storing video signals to be provided to said signal lines in said ordinary storage capacitors in response to operations of said switching elements; and applying said compensation pulses to said dummy scanning line.

13. A driving method of an active-matrix type liquid crystal display device including a plurality of ordinary scanning lines disposed in the row direction, a dummy scanning line, a plurality of signal lines provided in the column direction, said signal lines crossing said ordinary and dummy scanning lines to form cross points, switching elements disposed in the vicinities of the cross points, first and second groups of pixel electrodes connected to said switching elements, said second group of electrodes being disposed at a higher position than the top row of said first group of pixel electrodes or at a lower position than the bottom row of said second group of pixel electrodes, counter electrodes provided opposite to said first and second groups of pixel electrodes, liquid crystals controlled in accordance with potential differences between said pixel and counter electrodes, ordinary storage capacitors defined by said first group of pixel electrodes and said ordinary scanning lines, and additional storage capacitors defined by said second group of pixel electrodes and said dummy scanning line:

applying scanning pulses to said ordinary scanning lines to turn on said switching elements;

applying compensation pulses to said ordinary scanning lines to compensate for potential fluctuations at said pixel electrodes caused at the time when said switching elements change in state;

storing video signals to be supplied to said signal lines in said ordinary storage capacitors in response to operations of said switching elements; and applying said scanning pulses and said compensation pulses to said dummy scanning line.

* * * * *